US010473420B1

(12) United States Patent
Jones

(10) Patent No.: US 10,473,420 B1
(45) Date of Patent: Nov. 12, 2019

(54) ARCHERY RELEASE

(71) Applicant: H.I.T. Outdoors, LLC, Clay City, KY (US)

(72) Inventor: Brian K. Jones, Georgetown, KY (US)

(73) Assignee: H.I.T. Outdoors, LLC, Clay City, KY (US)

( * ) Notice: Subject to any disclaimer, the term of this patent is extended or adjusted under 35 U.S.C. 154(b) by 0 days.

(21) Appl. No.: 16/156,500

(22) Filed: Oct. 10, 2018

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
USPC ..... 124/35.2
See application file for complete search history.

(56) References Cited

U.S. PATENT DOCUMENTS 3,072,115 A * 1/1963 Johnson ..... F41B 5/1469 124/35.2
3,954,095 A * 5/1976 Lewis ..... F41B 5/1469 124/35.2
4,160,437 A * 7/1979 Fletcher ..... F41B 5/1469 124/35.2
4,309,975 A * 1/1982 Altier ..... F41B 5/1473 124/35.2
4,391,263 A * 7/1983 Dodge ..... F41B 5/1469 124/35.2
4,426,989 A * 1/1984 Sutton ..... F41B 5/1469 124/35.2
4,539,968 A * 9/1985 Garvison ..... F41B 5/1469 124/35.2
4,724,821 A * 2/1988 Besaw ..... F41B 5/1469 124/35.2
4,831,997 A * 5/1989 Greene ..... F41B 5/1473 124/35.2
5,261,581 A * 11/1993 Harden, Sr. ..... F41B 5/1469 124/23.1
5,273,021 A * 12/1993 Tepper ..... F41B 5/1469 124/35.1
5,307,966 A * 5/1994 Inaba ..... A44B 11/06 224/218
5,323,754 A * 6/1994 Pittman ..... F41B 5/1469 124/35.1
5,365,911 A * 11/1994 Todd ..... F41B 5/1469 124/35.1
5,435,291 A 7/1995 Woodward
(Continued)

*Primary Examiner* — Alexander R Niconovich
(74) *Attorney, Agent, or Firm* — Warner Norcross + Judd LLP

(57) ABSTRACT

An archery release including a release head, a wrist strap, a flexible connector between the head and strap, and a mounting base including a fastener that at least partially pierces the flexible connector and/or compresses the flexible connector against the mounting base to secure the flexible connector in a fixed position relative to the wrist strap. The mounting base and fastener facilitate secure adjustment of the length of the flexible connector between the wrist strap and the release head to thereby fit the stature of the archer. An archery release also is provided including a release head having a trigger stop post disposed in a trigger well and configured to impair or arrest movement of the trigger without the trigger engaging the material of the head.

20 Claims, 5 Drawing Sheets

(56) References Cited

U.S. PATENT DOCUMENTS 5,448,983 A * 9/1995 Scott ..... F41B 5/1469 124/35.2
5,653,214 A * 8/1997 Lynn ..... F41B 5/1469 124/35.2
5,937,841 A * 8/1999 Summers ..... F41B 5/1469 124/35.2
6,481,431 B1 * 11/2002 Summers ..... F41B 5/1469 124/35.2
6,763,819 B2 * 7/2004 Eckert ..... F41B 5/1469 124/35.2
6,766,794 B1 7/2004 Bently
7,278,415 B2 * 10/2007 Jones ..... F41B 5/1469 124/35.2
D597,164 S 7/2009 Jones
7,644,709 B2 * 1/2010 Tilby ..... F41B 5/1469 124/35.2
7,753,043 B1 * 7/2010 Eckert ..... F41B 5/1469 124/35.2
7,926,475 B2 4/2011 Jones
7,946,282 B2 5/2011 Jones
8,146,578 B2 4/2012 Jones
D688,346 S 8/2013 Jones
D697,575 S 1/2014 Jones
D697,992 S 1/2014 Jones
8,695,577 B2 * 4/2014 LoRocco ..... A41D 13/088 124/35.2
8,733,335 B2 5/2014 Pierce
8,746,222 B2 * 6/2014 Jones ..... F41B 5/1469 124/35.2
8,746,223 B2 * 6/2014 Jones ..... F41B 5/1469 124/35.2
8,869,781 B2 * 10/2014 Jones ..... F41B 5/1469 124/35.2
9,032,943 B1 * 5/2015 Coalson ..... F41B 5/148 124/35.2
9,255,761 B2 * 2/2016 Rentz ..... F41B 5/1469
9,612,077 B2 4/2017 Kelly
9,625,230 B2 4/2017 Kelly et al.
9,702,658 B2 7/2017 Horn
9,759,512 B1 * 9/2017 Keeton ..... F41B 5/1469
9,857,139 B2 1/2018 Kelly et al.
9,863,736 B2 1/2018 Kelly et al.
D816,792 S 5/2018 Kelly
9,970,731 B2 5/2018 Horn

* cited by examiner

ARCHERY RELEASE

BACKGROUND OF THE INVENTION

The present invention relates to an archery release aid, and more particularly to an archery release having a connector joining a wrist strap with a release head.

Conventional archery releases are designed to temporarily hold a bowstring of an archery bow so that an archer can pull on the release and subsequently draw the bowstring to shoot an arrow from the bow. Archery releases typically assist an archer in quickly and cleanly releasing the bowstring. In general, archery releases are intended to consistently release the bowstring when the archer shoots the arrow, and thus increase the accuracy of the shot.

Most releases include a head having one or more pivotable jaws that hold the bowstring, a trigger mechanism that actuates the jaws, and a wrist strap configured to wrap around an archer's wrist. In use, an archer nocks an arrow on the bowstring and secures the jaws of the release around the bowstring or an associated loop. The archer then draws the bowstring by pulling the release via the wrist strap. After the archer fully draws the bowstring, aims the bow and is prepared to shoot the arrow, the archer actuates the trigger mechanism. This moves the one or more jaws and subsequently disengages the bowstring so that the bowstring can utilize its stored energy and propel the arrow from the bow.

Some releases have adjustable connections that are configured to accommodate the physical attributes of an archer, for example, hand size, draw length and finger length and the like. A popular type of connector is referred to as a strap connector. This connector typically includes a strap connected at one end directly to a release head and at an opposing end directly to a wrist strap. The connector can be joined to the wrist strap with a special bar clamp having two screws that pushes a round or flat bar against the strap so that the length of the web between the wrist strap and head can be adjusted as desired by the archer.

An issue with current flexible connectors, however, is that with the bar clamp, the strap sometimes can be prone to sliding or to movement relative to the wrist strap. Their assembly can be tedious due to multiple components having to be connected to one another and the wrist strap. Further, adjustment of conventional bar clamp systems can be time consuming due to the number of components that are adjusted and manipulated to do so.

Accordingly, there remains room for improvement in connection with strap connector adjustment systems.

SUMMARY OF THE INVENTION

An archery release is provided including a flexible connector joined with a wrist strap via a fastener that at least partially pierces the flexible connector, which enables precise and reliable adjustment of a distance between the wrist strap and a release head.

In one embodiment, the flexible connector can include one or more flexible straps that enable the flexible connector to flexibly join the release head to the wrist strap, so that the head can be configured at an infinite number of orientations relative to the wrist strap.

In another embodiment, the archery release includes a mounting base joined with the wrist strap. The fastener can extend through a portion of the mounting base and can pierce at least one surface of the flexible connector, for example, an upper surface and/or a lower surface.

In still another embodiment, the fastener can be a pointed set screw having a point that pierces through at least a portion of the flexible connector. Optionally, the point can be a conical point, and can at least partially compress the flexible connector against a portion of the mounting base when engaging the same.

In even another embodiment, the mounting base can include a lower portion and a bridge disposed over the lower portion. The flexible connector can be disposed between the bridge and the lower portion, optionally through a hole defined by the base. The fastener can protrude into the hole, from the bridge toward the lower portion, and in so doing can pierce at least part of the flexible connector also disposed in the hole.

In even another embodiment, the fastener can include a pointed tip. The tip can pierce through and/or between strands of a fabric from which the flexible connector is constructed. The tip can project though and upper and/or lower surface of the flexible connector. In so doing, a portion of the tip also can press the flexible connector against the mounting base to hold the flexible connector in a fixed position.

In still a further embodiment, the archery release can include a trigger and the head can define a trigger well. The trigger well can be bounded by a first wall and a second wall, between which the trigger moves along a trigger path. A trigger stop post can extend between the walls, through the trigger well and can be positioned to arrest movement of the trigger along the path. This can prevent the trigger from slapping against a portion of the release head, for example, a third wall bounding the trigger well, where that wall is transverse to the trigger path.

In a further embodiment, the head can define one or more post holes that extend to the trigger well. The trigger stop post can be disposed in the post holes and in the trigger well. The trigger stop post also can be friction fit in the holes and secured in place relative to the trigger well.

A simple and efficient archery release is provided that enables an archer to precisely and consistently customize the release to the archer's physical stature and performance desires. With the mounting base and fastener, set-up and alteration of the flexible connector, and thus the fitment of the release to an archer is vastly simplified and made more efficient. Fewer parts are utilized and those parts are less prone to wear or loss. Where the release includes a trigger stop post, that post is well-secured to the release head and can prevent excessive wear and sometimes noise produced by the release.

These and other objects, advantages, and features of the invention will be more fully understood and appreciated by reference to the description of the current embodiments and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
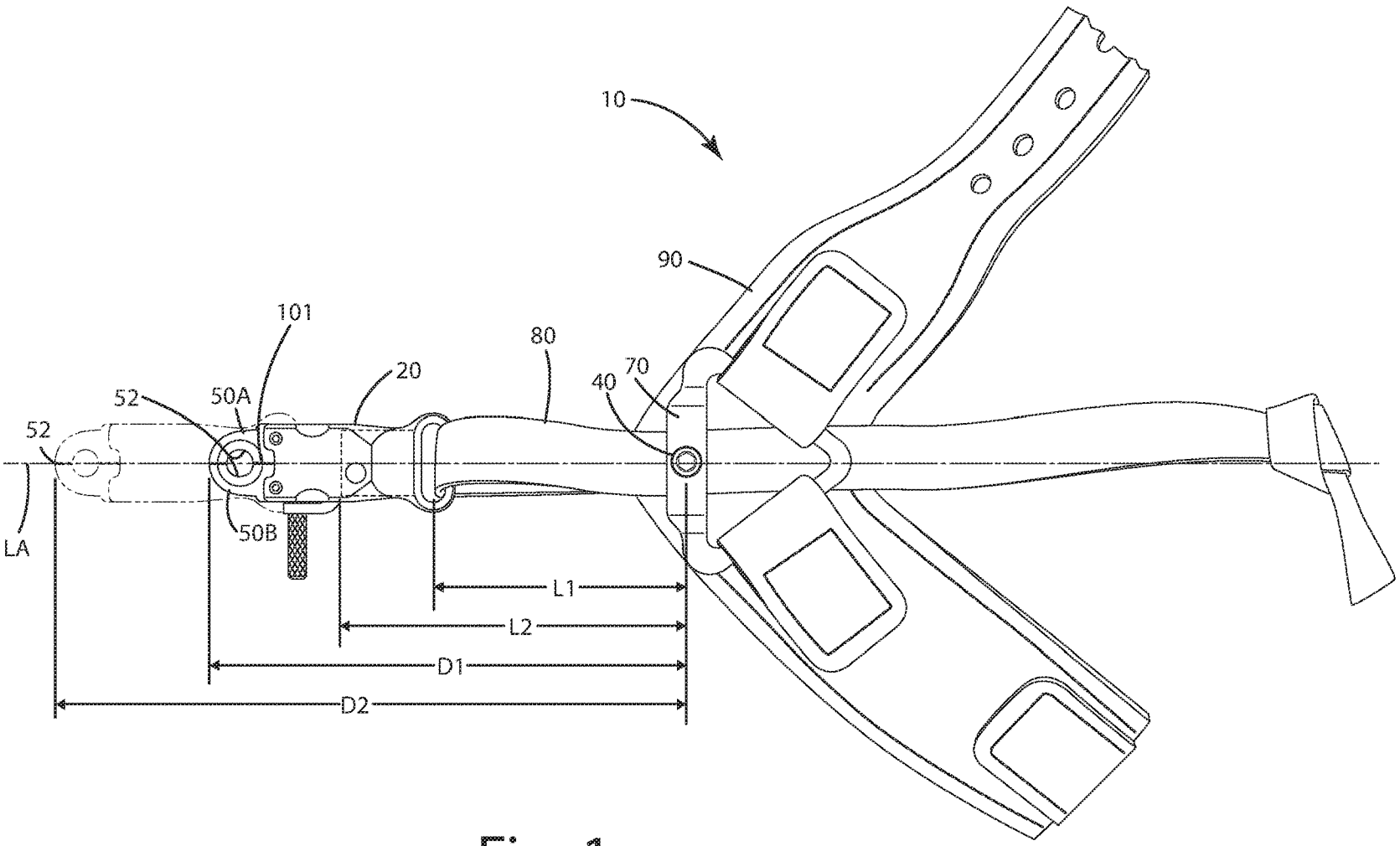
FIG. 1 is a top view of the archery release of a current embodiment with closed jaws and a first extension position in solid lines and second extension position in broken lines.

A current embodiment of the archery release is shown in FIGS. 1-5 and generally designated 10. The release 10 generally includes a release head 20 having a longitudinal axis LA, first and second moveable jaws 50A and 50B, and a trigger 60. The release head 20 can be joined with a flexible connector 80 which, as illustrated can include one or more straps 82, 83. The straps 82 can be secured via a mounting base 70 to the wrist strap 90. The mounting base can include a fastener 40 which is configured to pierce the flexible connector 80 and/or compress it within or against the mounting base to secure the straps in a fixed position relative to the mounting base. The release can include a trigger stop post 30 that is disposed in the path TP of the trigger 60 when it moves, so as to arrest movement of the trigger and prevent wear and tear on the remainder of the release head 20.

The release can be used to assist the archer in drawing and releasing the bowstring 101. When the release is in a closed position, as shown in FIG. 1, and used to draw the bowstring 101, the bowstring 101 is captured in one or both of the bowstring notches 52. The release 10 can be actuated from a closed position (FIG. 1) to an open position (FIG. 5) by an archer engaging and actuating the trigger 60.

The release 10 can be operated to adjust the overall distance D1 of the release head 20, and/or its components, such as the moveable jaws, bowstring notch, trigger and/or the like, from the wrist strap 90 to fit the archer. For example, the flexible connector 80 can be adjusted relative to the mounting base 70 and fastener 40 to adjust that overall distance D1 between the wrist strap 90 and the release head 20 and/or its components, such as the bowstring notch 52.

The release 10 can be extended from a generally retracted mode, shown in FIG. 1 in solid lines, having an overall distance D1 between the wrist strap 90 and release head 20, for example its bowstring notch 52 to one or more exemplary extended modes, shown in FIG. 1 in broken lines, where the overall distance D1 is increased to a greater distance D2. To do so, the flexible connector 80 can be extended from a first length L1 to a second length L2, greater than the first length. Optionally, the length of the flexible connector 80 can be variably adjusted to an infinite number of lengths, due to the nature of the engagement of the straps with the with the mounting base 70 and fastener 40, as described below.

As used herein, "bowstring" refers to an actual bowstring of an archery bow and any device or component adapted to join with a bowstring of an archery bow and aid an archer in drawing or releasing the bowstring, including rope loops, which are attached to the bowstring above and below the location where an arrow nock rests, and receivers, for example, a metal loop or partial loop that is joined with the bowstring above and below, or only above, or only below the location where the arrow nock rests on the bowstring.

As used herein "archery bow" refers to any compound bow, recurve bow, long bow, crossbow or any other device that propels or is capable of propelling an arrow, bolt or other similar projectile.

Further, although the releases illustrated and described herein are generally two jaw, dual caliper wrist strap releases, the constructions herein are well suited for any other type of archery release including, but not limited to, single caliper, single jaw releases, rope releases, back tension releases, thumb releases, plunger releases, pinky releases, releases with or without wrist straps, hunting releases, target releases and the like.

Referring to FIGS. 1-5 the components of the release 10 will now be described in detail. The release head 20 is generally elongate and includes moveable jaws 50A, 50B and a trigger 60. The jaws and trigger can be positioned in a recess 21, which can form all or part of trigger recess 22, and which can be sufficiently sized to house all or a portion of these and other components of the release. The release head 20 can further define apertures to accommodate various pivot elements, such as pins, to join the trigger 60 and jaws 50A, 50B with the head 20 as desired.

Figure 5:
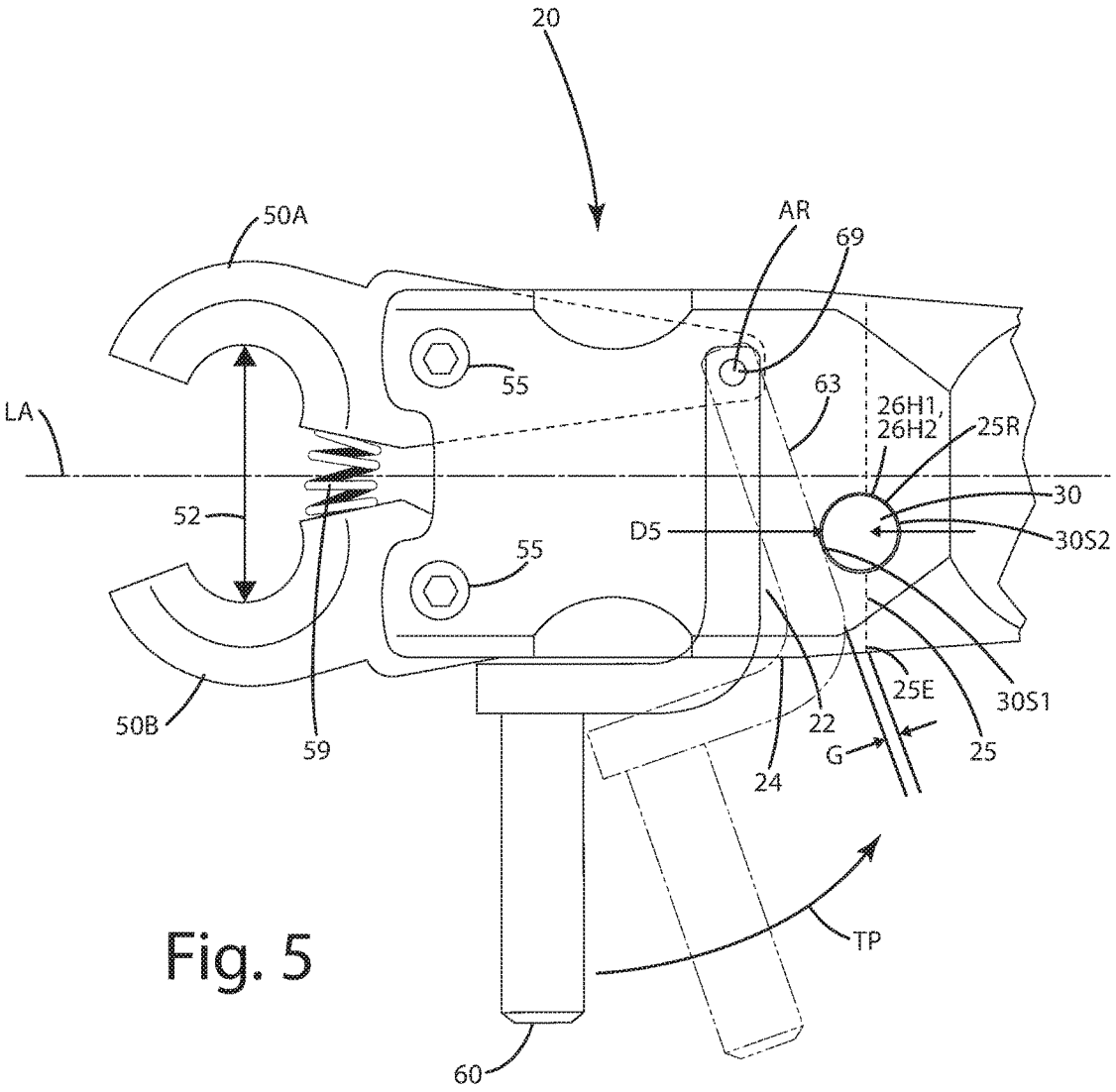
FIG. 5 is a partial section view of the trigger stop post arresting travel of the trigger.

The moveable jaws 50A and 50B can be constructed in a variety of configurations. In general, a suitable construction enables the movable jaws to move away from one another, or more generally it enables at least one jaw to move to release the bowstring from the bowstring notches 52. With reference to FIG. 5, the movable jaws can be pivotally mounted via pivot elements 55 to the release head 20. At a rearward portion of a jaw, a roller (not shown) can be joined with the movable jaw 50B. In general, the roller can engage a sear (not shown) of the trigger 60. A variety of other elements can be substituted for the roller, such as ball bearings, non-rotating elements, sliding elements or any structure that enables the movable jaws 50A and 50B to open, or a single jaw to open or otherwise move in other release constructions.

As shown in FIG. 1, the movables jaws 50A and 50B define bowstring notches 52. The bowstring notches can include a curvilinear, planar or other smooth surface configured to minimize wear on a bowstring. The bowstring notches can be disposed along or can face the longitudinal axis LA of the release head 20. In general, each notch can be U or V shaped opening or recess defined by the movable jaws 50A, 50B, generally configured to capture at least a portion of the bowstring 101.

Between the movable jaws, or optionally the release head 20, a bias member 59 (FIG. 5), such as a coil spring, a leaf spring, a rubber or other elastomeric element, can be positioned to urge the movable jaws open when the trigger 60 is actuated from a holding mode to a triggered mode. The bias member 59 can be located forward or rearward of the pivot pins 55 to assist in urging the movable jaws open. Other mechanisms for performing similar or different movement can be substituted as desired.

Figure 4:
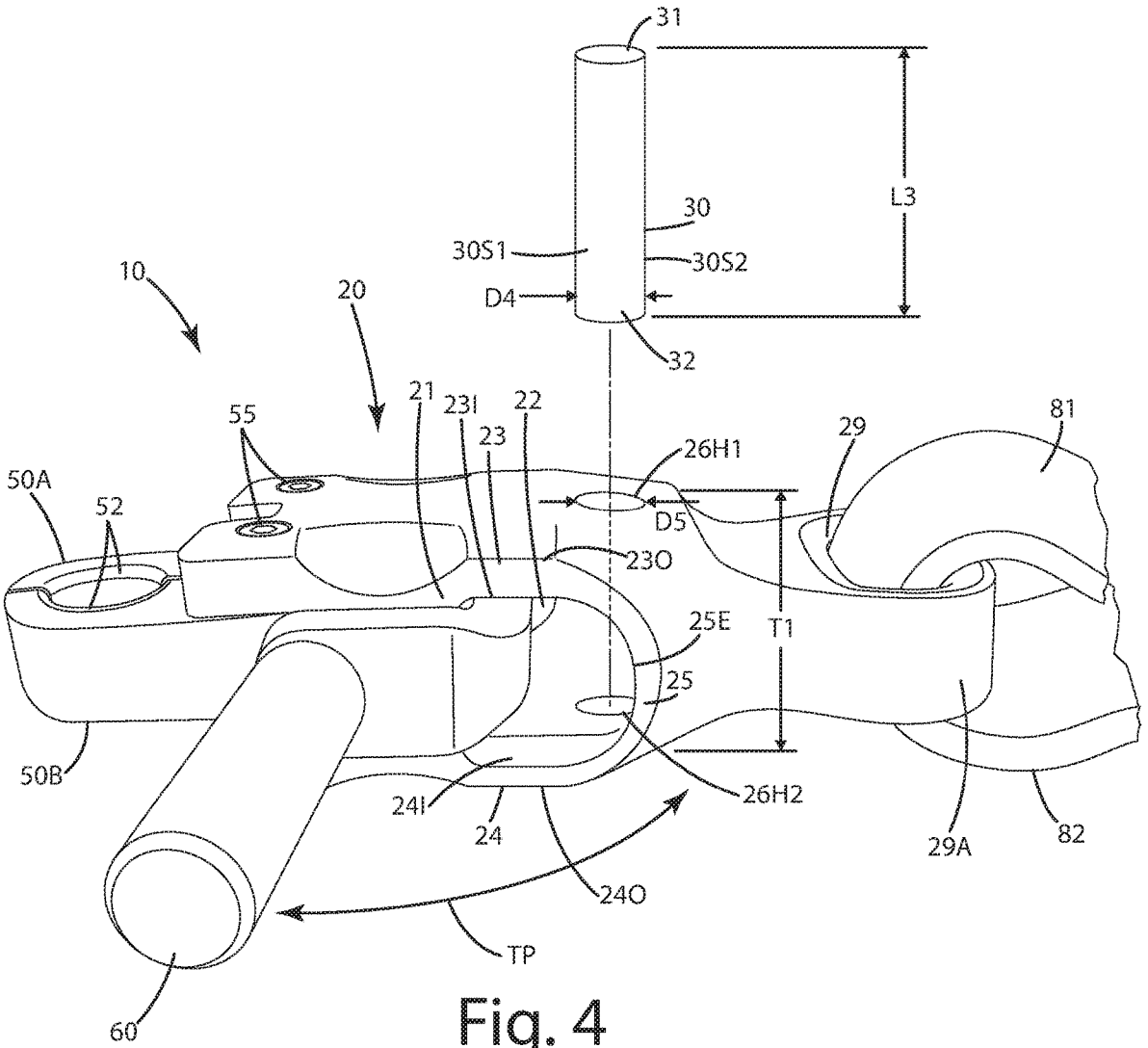
FIG. 4 is a side perspective view of the release head with a trigger stop post being installed transverse to a trigger well and trigger path of a trigger.

With reference to FIGS. 1, 4 and 5, the release head 20 can include a trigger 60 which extends from the head and is accessible by an archer with one of the archer's digits, for example, an index finger or a thumb depending on the configuration. The trigger 60 pivots about a pivot pin 69 joined with the jaw 50A. The trigger is located in the trigger well 22. The trigger moves along a trigger path TP, which as illustrated can be an arcuate path about an axis of rotation AR. Of course, in other constructions, the trigger path can be more or less linear. The trigger can move along the trigger path TP from a set mode (FIG. 1) in which the jaws are closed about the bowstring 101, to a release mode (FIG. 5), in which the jaws are opened, allowing the bowstring to be released 101 by the release 10. The trigger 60 can include a trigger adjustment element (not shown) which, for example, can be a set screw that is threadably engaged with the trigger. The trigger adjustment element can be threaded inward or outward with respect to the trigger 60 to adjust the sensitivity of the trigger pull.

As mentioned above, the release head 20 can define a trigger well 22. The trigger well 22 can be bounded by a first wall 23 and a second wall 24, as well as a third wall 25. The trigger 60 can be disposed between the first and second walls 23 and 24 and can move toward and away from the third wall 25, depending on the mode. The third wall 25 can be transverse to the trigger path TP along which the trigger 60 travels. The first wall 23 can include an inner surface 231, which face toward the trigger 60 and inward into the trigger well 22 and an outer surface 23O. The second wall 24 can include an inner surface 24I and an outer surface 24O. The respective inner surfaces of the first wall and the second wall can face toward one another and confine the triggers movement on the trigger path. Optionally, these surfaces can be parallel. Near the third wall 25, the first and second walls can define first and second post holes 26H1 and 26H2 respectively. The first wall 23 can define the first post hole 26H1 that extends optionally through the wall, from the outer surface 23O to the inner surface 231. The second wall 24 can define the second post hole 26H2 that extends optionally through that wall, from the outer surface 24O to the inner surface 24I. Thus, both of the post holes can extend to the trigger well. Although shown as extending completely through the walls, either or both of these holes 26H1 and 26H2 optionally can extend only partially through the walls, and/or through only one of the walls. Further, the holes as illustrated are of a smooth cylindrical bore. In some cases however, they may be at least partially threaded, for example when the trigger stop post 30 is fully and/or partially threaded so that those posts can be received in those respective threaded holes.

The trigger stop post 30 can be in the form of an elongated bar as illustrated. This post can be cylindrical, as shown, or it can be of an ellipsoid, square, rectangular, triangular, polygonal or other geometric cross-section, and can be of a variety of lengths. As illustrated, the length L3 of the trigger stop post can be selected so that it is equal to or slightly less than the thickness T of the release head 20. This is so that the first end 31 and second end 32 of the trigger stop post 31 are flush with or slightly below the outer surfaces 23O and 24O, so that those surfaces do not have any projections that could potentially snag on objects. Optionally, the diameter D5 of one or more of the holes 26H1 and 26H2 can be the same as or slightly smaller than the diameter D4 of the trigger stop post 30. Thus, the trigger stop post 30 can be installed in those holes via a friction fit. To install the post 30, it can be hammered or pounded at one of the ends through the holes 26H1 and 26H2 until its ends 31 and 32 are flush with the outer surfaces or disposed slightly inward with regard to those surfaces. The trigger stop post 30, when installed, can be transverse to the trigger path TP along which the trigger moves away from the set mode (FIG. 1) to a release mode (FIG. 5). Optionally, the trigger stop post 30 can be disposed perpendicular to the plane in which the trigger path TP is located.

The trigger stop post 30 also can be disposed in a particular orientation relative to the third wall 25. For example, the trigger stop post 30 can be disposed at the bottom of the well 22, adjacent the third wall 25, which can be the bottom wall of the trigger well 22. In some cases, the trigger stop post 30 can be disposed distal from the wall 25 and within the trigger recess 22 completely. In other cases, as illustrated in FIG. 5, the trigger stop post 30 can be disposed at least partially in the bottom wall 25. For example, the trigger stop post 30 can include a first surface 30S1 and a second surface 30S2. The first surface 30S1 can be exposed and can extend into the recess 22. The second surface 30S2, however, can be disposed at least partially in the third wall 25. In some cases, that second surface 30S2 can be concealed or extend within an optional recess 25R that is formed in the bottom wall 25 of the recess 22.

Optionally, when the post 30 is installed, the first surface 30S1 can be disposed a distance D5 from the third wall 25. This distance D5 can be sufficient so that the trigger 60, for example, in the engagement surface 63 of the trigger 60, will engage the first surface 30S1 and prevent the other portions of the trigger 60 from engaging or slapping against the bottom wall 25, for example, an edge 25E of the bottom well that forms an outer portion of the recess 22. In some cases, the distance D5 is greater than the gap G between the trigger engagement surface 63 and the edge 25E of the bottom wall 25. Optionally the distance D5 can be expressed in a ratio relative to the gap dimension G, for example, a ratio of optionally at least 1.5:1, further optionally at least 2:1, yet further optionally between 1:1 and 10:1. Of course, other ratios can be selected depending on the application and the configuration of the components.

Optionally, the trigger stop post 30 can be constructed from a polymeric material, fiberglass, carbon, composite, a soft metal, such as magnesium, natural or synthetic rubber, nylon, polyurethane, elastomers, mixtures thereof, and/or other materials. The other components of the release, for example the walls and the jaws can be constructed from a variety of materials, for example, metal, such as steel, stainless steel and aluminum, as well as other synthetic materials such as polymers, and any combination of the foregoing. Further, the release 10 and its components can be treated with special processes, for example, anodizing, dipping or filming to provide the release and its components with a desired finish and appearance. Further optionally, the trigger stop post can be constructed from a material different from the other components of the release, for example the walls. In one example, the trigger stop post can be constructed from a polymer, and the walls can be constructed from a metal, such as aluminum.

The position of the trigger stop post 30 can be selected so that it projects into the trigger well 22 a sufficient distance configured to arrest movement of the trigger 60 as it travels along the trigger path TP from the set mode, shown in solid lines in FIG. 5 to the triggered or release mode, shown in broken lines in FIG. 5. Due to the engagement surface 63 engaging the surface 30S1, the trigger stop post 30 impairs (which includes stops) the trigger and its engagement surface 30 or other surfaces from slapping against or otherwise engaging the release head, for example, the third wall 25 and its components, after having been triggered and after moving along the travel path TP. The trigger stop post 30 can be positioned adjacent the third wall 25, closer to the trigger than the third wall, so that this trigger stop post blocks the trigger from engaging the third wall. This can prevent the third wall, which can be constructed from metal, from being pounded multiple times by the trigger and wearing down, thereby changing the trigger travel characteristics and feel of the trigger of the release. Optionally, where the trigger stop post 30 is constructed from a softer polymer or an elastomer, the trigger stop post can optionally arrest movement of the trigger, and/or slow it down in a manner that does not produce an audible or very audible snap or click due to the collision of the trigger against it. For example, the trigger post can be constructed from an elastomer disposed entirely or substantially in the trigger well. When the trigger engages material of the trigger stop post, it can slow it down over a small distance to reduce the noise produced due to the trigger being actuated.

As shown in FIG. 1, the release head 20 can include a longitudinal axis LA which generally extends the length of the release head 20. In general, this longitudinal axis LA typically can be aligned with and/or parallel to the forward travel path of a bowstring 101 as it is released from the release 10. Of course, in some circumstances, the longitudinal axis LA may not be perfectly aligned with the bowstring travel path, depending on the configuration of the bowstring and the archery bow to which it is attached.

As mentioned above, and with reference to FIGS. 1-4, the release head 20 can be joined with a flexible connector 80. These components can be joined in a variety of manners. As illustrated, the release head 20 can define a tether loop or hole 29. This tether hole can be sized to accommodate the flexible connector 80, and can form that connector into the first 81 and second 82 straps, which can be placed in and/or through it. The straps can be folded over onto one another and can extend rearward toward the wrist strap 90, generally parallel to one another, but separated by the tether loop 29 adjacent the release head 20. Near the wrist strap, the straps can be placed immediately adjacent and can engage one another, generally stacked one on the other, as described further below. The flexible connector 80 and its straps 81, 82 can be aligned along and/or parallel to the longitudinal axis LA of the release head 20 when the release 10 is used to hold a bowstring 101.

The flexible connector 80 and its straps 81 and 82 can be flexible, that is, can flex and/or bend relatively easily, optionally under the weight of the release head 20, to enable the orientation of the release head 20 to be altered relative to the wrist strap 90. Although the flexible connector and its straps are illustrated in the form of a generally flat web, these components can be in the form of a cord, rope, strap, wire, or some other flexible connector, all of which are considered a web herein. As shown in the form of a web, the flexible connector and the straps can be constructed from a plurality of strands 80S. The strands 80S can be weaved, knitted or otherwise mechanically joined and or sewn to another.

Figure 2:
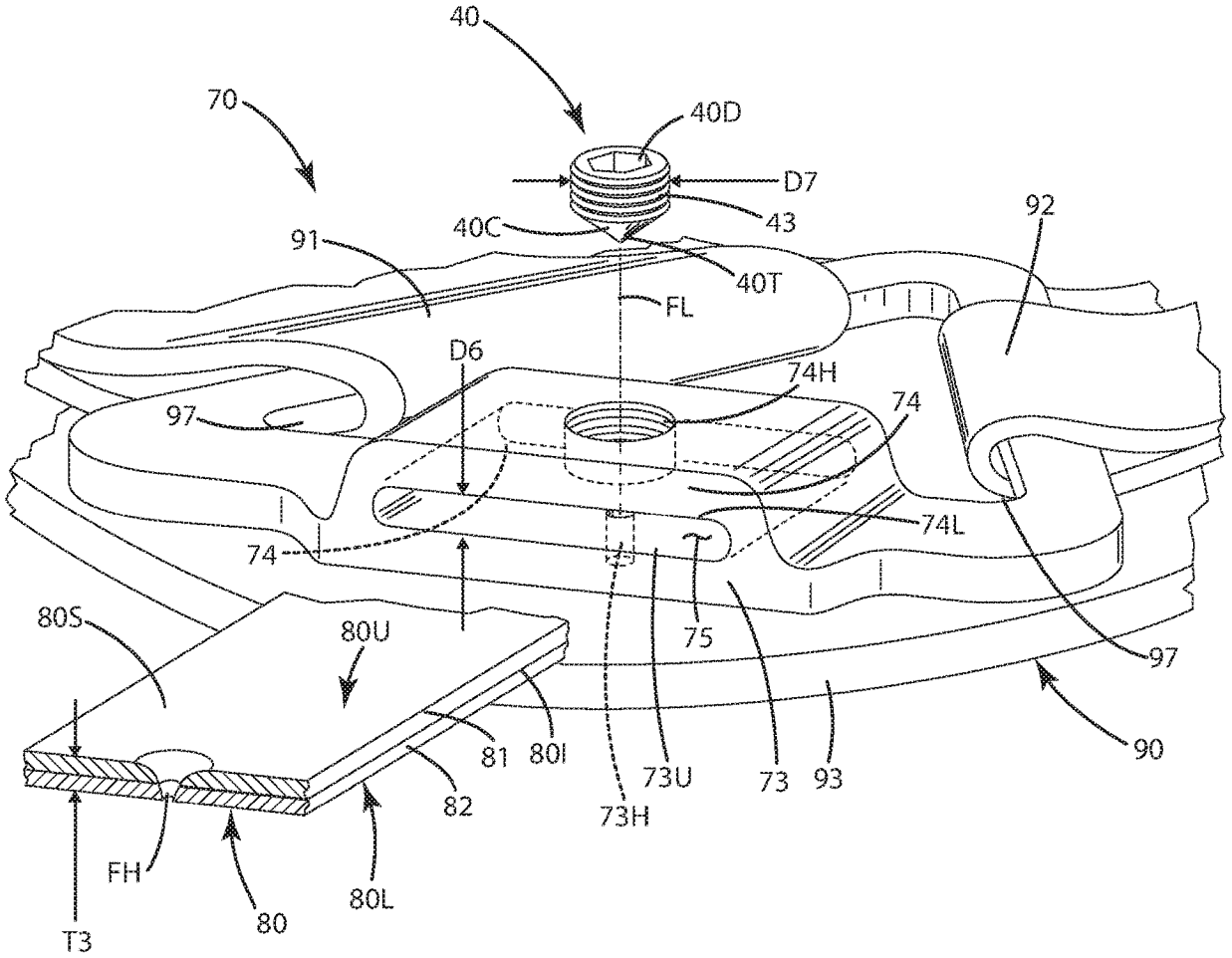
FIG. 2 is a perspective side view of a mounting base and flexible connector being assembled.

The flexible connector 80, as shown in FIG. 2, can include an upper surface 80U and a lower surface 80L. The upper surface 80U can be a portion of the first strap 81, for example an upper surface of that strap. The lower surface 80 L can be a portion of the second strap, for example, a lower surface of the second strap 82. The opposite surfaces of the first and second straps can engage in be immediately adjacent one another at the strap interface 80I.

As mentioned above, the flexible connector 80, can be adjustable to enable the distance between the release head 20 and the wrist strap 90 to be varied and thereby accommodate the personal preferences and/or physical anatomy of an archer. To provide such adjustment, the release 10 can include the mounting base 70 and the fastener 40, which collectively can be referred to as an adjuster. The mounting base 70 is secured to the wrist strap 90. This optionally can be done via first 91 and second 92 securement straps that are stitched down to the wrist strap 90 and that extend through respective openings 97 defined by the mounting base 70. The mounting base 70 itself can include a lower portion 73 which can extend into and/or form a ring or connector component that is secured to the remainder of the wrist strap 90. The lower portion 73 can include an upper engagement surface 73U that is configured to engage at least a portion of the flexible connector 80 as described below.

The mounting base 70 can be configured to secure the flexible connector 82 the wrist strap in a fixed, static configuration and to provide an adjustment to the length of the flexible connector between the release head and the wrist strap, and more generally to alter the distance between the release head, and one of its components, such as the bowstring notch, and the wrist strap. The mounting base 70 can include a bridge 74 that is disposed over the lower portion 73 and spaced from the lower portion a distance D6. Distance D6 is optionally less than the thickness T3 of the flexible connector 80. This is so that the flexible connector can fit within and through the opening 75 that is defined by the mounting base 70, generally between the bridge 74 and the lower portion 73.

Optionally, the bridge 74 and lower portion 73 can be formed as an integral single piece part, constructed from metal, composites, polymers and/or mixtures thereof. The opening 75 can be bounded by the surface 73U of the lower portion 73 as well as the lower surface 74L of the bridge 74. Optionally, the bridge and/or lower portion can include other surfaces that join these elements. The surfaces around the opening 75 can be rounded so they do not cut and/or abrade the connector 80 when it is disposed therethrough.

The bridge 74 can define a hole 74H which optionally can be threaded. This hole 74 can be configured to receive the fastener 40. The fastener can be threaded and can include a tip below a diameter D7 of the remainder of the fastener 40. As illustrated, the fastener can be in the form of a set screw including a drive element 40D that is distal from the tip 40T. The tip 40T can be at least partially of a conical structure 40C. The threads 43 of the fastener 40 can terminate at that conical structure 40C. The conical structure 40C can taper to and can transition to the tip 40T, which again can form a point. The fastener 40 can be threaded into the hole 74H.

Figure 3:
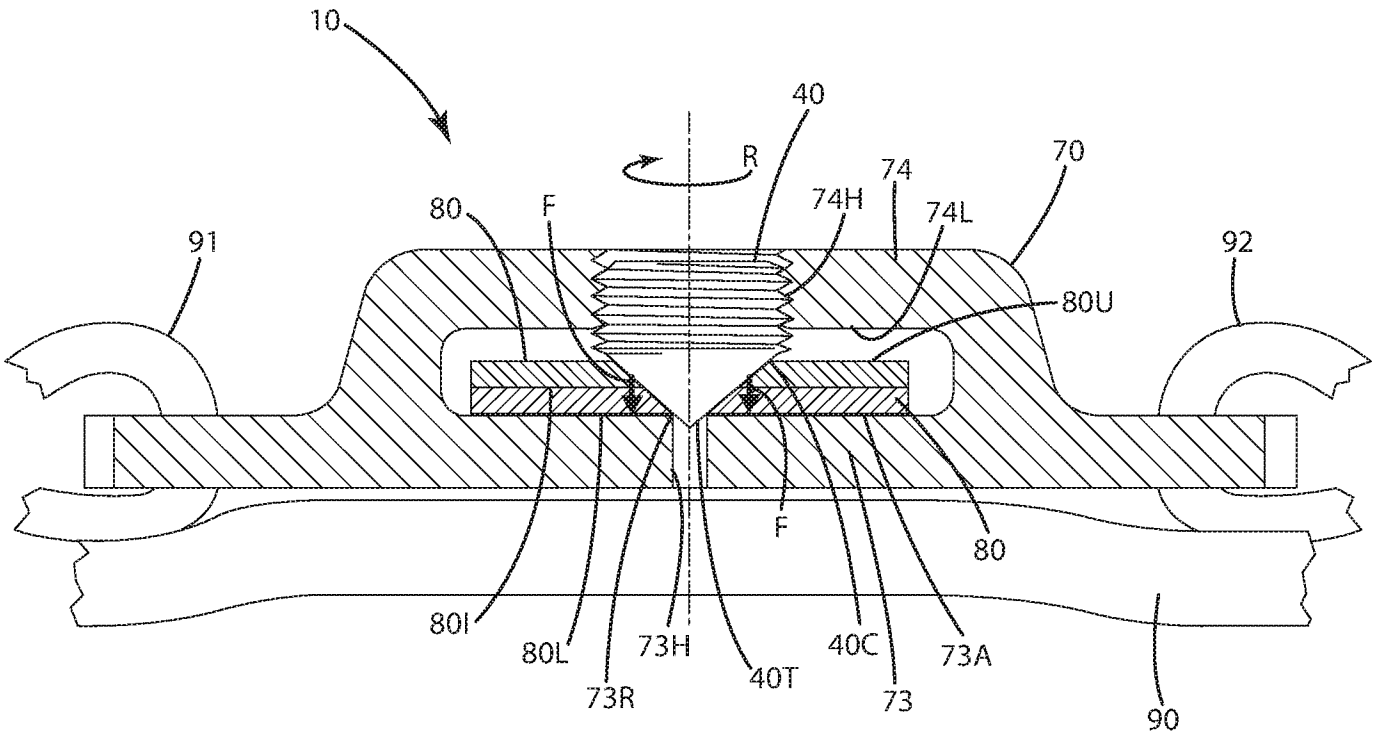
FIG. 3 is a section view of the flexible connector secured in the mounting base, thus securing a release head to the wrist strap at a fixed length.

As shown in FIGS. 2 and 3, the lower portion 73 can define a hole 73H. This hole 73H can be aligned with the fastener axis FA which corresponds to a longitudinal axis of the hole 74H in the bridge 74. With this alignment of the hole, the tip 40T of the fastener 40 can seat and/or project at least partially into or align with the hole 73H when the set screw 40 is installed in the bridge 70 to secure the flexible connector 80.

Returning to FIG. 3, the fastener 40 can be tightened via rotation in direction R such that the tapered surface 40C in the remainder of the fastener presses against the flexible connector 82. In so doing, the fastener compresses the flexible connector 80 with a force F against the lower portion 73, for example the upper engagement surface 73U of that lower portion. In so doing, the tip can pierce at least the upper surface of the flexible connector. Upon further tightening, the tip can pierce the lower surface of the flexible connector. Optionally, as the conical surface and/or tip pierces the web of the straps 81 and 82, that tip can extend between adjacent ones of multiple strands 80S. The tip can separate the strands from one another relative to a state in which the straps and web are not engaged by the tip. The tip can sometimes sever and/or deform the strands in the web. In some cases, the tip pierces through the first strap 81 but not the second strap 82. In other cases, the tip pierces through both the first strap 81 and the second strap 82. Optionally, the strap can pierce through the upper surface 80U and the lower surface 80L. In other cases, optionally the tip 40T can pierce through the upper surface 80U but not the lower surface 80L. Sometimes, the tip 40T can pierce through both of the surfaces of the strap at the interface 80I, which is where the two straps lay against one another.

As used herein, when an element such as a fastener or its tip pierces a surface, a strap, a flexible connector and/or a component in general, the element can penetrate into the surface or component a distance such that the surface is modified and/or deformed, temporarily or permanently, and/or elements, such as strands at or near the surface are separated from one another by the fastener or tip and/or the tip tears, punctures, modifies and/or otherwise mars at least one of the surface, strap, flexible connector and/or component.

Optionally, as noted above, the screw 40 can be tightened to such a degree that the tip 40T at least partially enters the hole 73H in the lower portion 73. In some cases the tip can drag or push parts of or strands of the first and/or second strap into the opening of the hole 73H when the screw is sufficiently tightened. The tip 40T optionally can pierce completely through the flexible connector from the upper surface to the lower surface so that a small hole FH is formed in the flexible connector, through the first and second straps. The tip 40T and/or the conical surface 40C can engage the rim 73R around the hole 73H in such a manner that the fastener 40 is bottomed out and cannot be rotated in direction R any farther. This can provide feedback to the user that the fastener 40 is sufficiently installed to secure the flexible connector 80 a fixed position and/or orientation relative to the mounting base 70. As a result, the length of the flexible tether is fixed and the distance between the mounting base, wrist strap and the release head, for example, the bowstring notch can be fixed. To further alter this length the perspective distance, for example from distance D1 and D2, a user can unscrew the fastener 40 which causes the tip 40T and tapered surface 40C to disengage the flexible connector 80. The flexible connector and straps can then be pulled or pushed through the opening 75 to adjust the distance D1 to the distance D2, and the length L2 from length L1.

As shown in FIG. 3, the fastener 40 is installed relative to the mounting base 70 and the flexible connector 80. In particular, the fastener is threaded into the hole 74H and extends at least partially through the hole 74 so that the tip 40T and conical or tapered portion 40C extends below the lower engagement surface 74L of the bridge 74. The tip 40T itself at least partially pierces the upper surface 80U of the flexible connector 80.

Optionally, in applications where the flexible connector 80 is adjusted multiple times and the fastener tip 40T pierces the flexible connector 80, the flexible connector can be permanently deformed to include one or more fastener holes FH, as shown in FIG. 2. That fastener hole FH can be formed by the tip 40T piercing complete the flexible connector and permanently deforming the straps and that connector so that the hole FH is formed. Of course, in other cases, a complete through hole might not be formed, rather an observable indent or deformation in the flexible connector may be formed. In some cases, where multiple fastener holes FH are formed in the strap, the user may replace the flexible connector to reduce the likelihood of the flexible connector breaking under significant force when being used. It is intended, however, that the flexible connector and the respective straps be sturdy enough that they can be pierced and reused multiple times after multiple adjustments in length of the flexible connector and adjustment of the distance as noted above.

The wrist strap 90 of the release 10 can be constructed from a flexible material and adapted to wrap around an appendage, such as a wrist, a forearm, and/or a hand of an archer. The wrist strap 90 can be constructed from leather, plastic, fabric and/or other materials or composites depending on the desired look and feel of the wrist strap. The wrist strap 90 can include a first portion 91 and a second portion 92, generally joined with one another at an apex 93 of the strap 90. These portions can be configured to attach with one another when wrapped around the appendage of an archer, for example, a wrist, forearm or hand of an archer. Generally, when the wrist strap 90 is attached to the archer, it can form a tear drop shaped loop as shown in FIG. 1. Although the wrist strap 90 is illustrated as a buckle-type wrist strap, other wrist strap configurations can be substituted in the archery release 10.

In general, the components of the release, such as the release head, first adjuster and adjuster linking element can be molded, machined and/or extruded to obtain their desired configuration. These components can also be treated with special processes as described above to provide a desired finish. Other components, such as the wrist strap and flexible connector can be molded, extruded, die cut, and/or sewn to construct them. With the components constructed, the release 10 is assembled.

To assemble the release, the components of the release head 20 are joined therewith. The various components of the release head can be ground or filed to remove to any excess material and lubricated to optimize movement and provide crisp actuation as desired. The flexible connector and its respective straps can be placed through the loop hole 29 of the head. The straps can be folded over and stacked upon one another. The flexible connector can then be placed through the opening 75 of the mounting base 74. The fastener 40 can be tightened in direction R. The tip 40T can pierce at least a portion of the flexible connector 80 and can compress the connector against the lower portion of the base. Accordingly, this can secure the fusible connector in a fixed, static position and orientation relative to the base and/or wrist strap. This in turn can set the distance between the release head and the wrist strap as noted above.

To operate the release, an archer places the wrist strap 90 on the archer's wrist, generally wrapping the first and second wrist strap portions 91, 92 around the archer's appendage and connecting those wrist strap portions so that they form a generally tear drop shape, with the apex 93 of the wrist strap 90 facing forward toward the archer's fingers.

The archer actuates the release so the moveable jaws 50A, 50B are in the open position shown in FIG. 5. The archer then positions these jaws adjacent the bowstring 101 of an archery bow which the archer intends to draw with a release 10. The release 10 grasps the bowstring 101 with the moveable jaws 50A, 50B so that the bowstring is within the notches 52. The moveable jaws 50A, 50B are then moved toward one another to capture the bowstring 101, as shown in FIG. 1. The archer then draws the bowstring 101 to a drawn state with the assistance of the release 10.

After the archer satisfactory aims the bow, the archer actuates the release with a trigger 60 to release the bowstring 10 from the moveable jaws 50A and 50B. As noted above, when the trigger 60 travels along the trigger path TP, it eventually engages the trigger post stop 30 to stop its movement along that trigger path TP. This can impair or prevent the trigger for engaging other parts of the release head, such as the third or bottom wall 25.

The release also can be operated to precisely and consistently configure the release to fit the archer. For example, an archer can precisely and consistently alter or adjust the overall distance between the release head and/or its components, such as the bowstring notch 52 and the wrist strap 90 of the release 10. This fits the release to the archer's hand size, wrist size, draw length, or other physical characteristics.

As mentioned above, the archer can adjust the overall distance between the wrist strap and the bowstring notch 52 to other overall distances D1 or D2, or any other infinite number of distances. To do so, the archer can adjust the length of the flexible connector 80 thereby change the distance between the bowstring notch 52 and the wrist strap for example. As mentioned above, to do this, the user can loosen the fastener 40 from the hole 74H in the bridge 74. This backs the tip 40T out from the piercing engagement with the flexible connector. Optionally, a fastener hole FH is formed after the fastener is backed out. The user can then pull the release head 20 so that the overall distance from the wrist strap increases from D1 to D2. This, in turn increases the length of the flexible connector from L1 to L2 between the mounting base and the head. The archer can then re-engage and tighten the fastener such that the fastener again pierces at least a portion of the flexible connector as described above. The fastener can compress the flexible connector 80 against the lower portion 73. The fastener can securely grab and engage the flexible connector via the tip 40T and the tapered surface 40C. This, in turn, anchors the flexible connector so that it is in a secured position relative to the mounting base.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z. Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The embodiments of the invention in which an exclusive property or privilege is claimed are defined as follows:

1. An archery release comprising:

a release head having a longitudinal axis;

a movable jaw joined with the release head, the movable jaw movable between a closed position and an open position, the movable jaw defining a bowstring notch configured to restrain a bowstring in the closed position;

a wrist strap configured to engage an archer's appendage;

a flexible connector joined with the wrist strap and extending to the release head, the flexible connector including an upper surface and a lower surface;

a mounting base joined with the wrist strap, the mounting base including a lower portion and a bridge disposed over the lower portion, the flexible connector disposed between the bridge and the lower portion of the mounting base, the bridge extending over the upper surface of the flexible connector so that the upper surface is adjacent the bridge, the lower portion extending under the lower surface so that the lower surface is adjacent the lower portion; and a fastener extending through the bridge and directly engaging the upper surface of the flexible connector so that at least the upper surface of the flexible connector is deformed by a tip of the fastener and the flexible connector is compressed against the lower portion of the mounting base and the flexible connector is secured in a fixed orientation relative to the mounting base, whereby the fastener and flexible connector are adjustable to enable an archer to select a distance between the mounting base and the release head to fit the release to the archer, wherein the bridge is set at a fixed distance above the lower portion, wherein the fixed distance does not change as the flexible connector is compressed against the lower portion of the mounting base.

2. The archery release of claim 1, wherein the bridge defines a threaded hole, wherein the fastener is threaded and extends through the threaded hole.

3. The archery release of claim 2, wherein the fastener is a set screw, wherein the set screw includes a tip, wherein the tip pierces the upper surface of the flexible connector.

4. The archery release of claim 3, wherein the tip pierces the lower surface of the flexible connector.

5. The archery release of claim 4, wherein the lower portion of the mounting base defines an aperture, wherein the tip is seated at least partially in the aperture.

6. The archery release of claim 1,
wherein the fastener includes a conical tip,
wherein the flexible connector includes a web of a plurality of strands,
wherein the conical tip pierces the web and extends between adjacent ones of the plurality of strands.

7. The archery release of claim 1,
wherein the flexible connector includes a first strap and a second strap,
wherein the first strap and second strap are stacked on one another and extend between the lower portion and the bridge,
wherein the fastener is pierced through the first strap.

8. The archery release of claim 7,
wherein the fastener is a set screw,
wherein the set screw includes a tip,
wherein the tip is pierced through the upper surface of the flexible connector, the upper surface being a portion of the first strap,
wherein the tip is pierced through the lower surface of the flexible connector, the lower surface being a portion of the second strap.

9. The archery release of claim 8,
wherein the lower portion includes an aperture aligned with the fastener,
wherein the tip is disposed at least partially in the aperture.

10. The archery release of claim 7, comprising:
a trigger;
wherein the release head defines a trigger well, the trigger well bounded by a first wall and a second wall,
wherein the trigger is moveably disposed in the trigger well, between the first and second walls,
wherein a trigger stop post extends between the first wall and the second wall,
whereby the trigger engages the trigger stop post to arrest movement of the trigger.

11. The archery release of claim 10,
wherein the first wall defines a first post hole that extends to the trigger well,
wherein the trigger stop post is disposed in the first post hole and in the trigger well,
wherein the trigger stop post is positioned in the trigger well and configured to arrest movement of the trigger,
whereby the trigger is impaired from slapping against the release head.

12. An archery release comprising:
a release head;
a wrist strap configured to engage an archer;
a flexible connector extending between the release head and the wrist strap;
a mounting base joined with the wrist strap and including a bridge that extends over the flexible connector; and
a fastener extending through the bridge and at least partially piercing an upper surface of the flexible connector to secure the flexible connector in a fixed position relative to the mounting base;
wherein the upper surface of the flexible connector is deformed when the upper surface is at least partially pierced by the fastener;
wherein the bridge remains static, without being compressed against the flexible connector, as the fastener secures the flexible connector in a fixed position relative to the mounting base.

13. The archery release of claim 12,
wherein the fastener includes a pointed tip,
wherein the fastener and flexible connector are configurable to establish a distance between the wrist strap and the release head so as to fit the archery release to an archer.

14. The archery release of claim 12,
wherein the release head defines a trigger well within which a trigger is movably disposed,
wherein a trigger stop post extends through at least a portion of the release head and through at least a portion of the trigger well,
wherein the trigger stop post is configured to arrest movement of the trigger, whereby the trigger is impaired from slapping against the release head when the trigger ceases movement after having been triggered.

15. The archery release of claim 12,
wherein the fastener includes a tip,
wherein the tip is pierced at least partially through the flexible connector,
wherein the fastener compresses the flexible connector against a lower portion of the mounting base that is distal from the bridge.

16. The archery release of claim 12,
wherein the fastener is a set screw,
wherein the set screw includes a tip,
wherein the tip is pierced through a first surface of the flexible connector, the first surface being a portion of a first strap,
wherein the tip is pierced through a second surface of the flexible connector, the second surface being a portion of a second strap.

17. The archery release of claim 16,
wherein the first strap and second strap extend through a hole defined in the mounting base under the bridge,
wherein the fastener extends into the hole, through the bridge,
wherein the fastener is a threaded screw.

18. An archery release comprising:
a release head;
a movable jaw defining a bowstring notch that is configured to restrain a bowstring, the moveable jaw joined with the release head;
a wrist strap configured to engage an archer, the release head joined with the wrist strap;
wherein the release head defines a trigger well within which a trigger is movably disposed,
wherein a trigger stop post extends through at least a portion of the release head and through at least a portion of the trigger well,
wherein the trigger stop post is disposed transverse to a path of movement of the trigger, and configured to arrest movement of the trigger,
whereby the trigger is impaired from slapping against the release head,
wherein the trigger well is bounded by a first wall and a second opposing wall, and a third wall extending between the first wall and the second wall,
wherein the trigger stop post extends from the first wall to the second wall,
wherein the first wall defines a first hole and the second wall defines a second hole, and
wherein the trigger stop post includes a first end disposed in the first hole and a second end disposed in the second hole, with a portion therebetween that extends through the trigger well.

19. The archery release of claim 18, wherein the trigger stop post is positioned adjacent the third wall and closer to the trigger so that the trigger stop post blocks the trigger from engaging the third wall.

20. The archery release of claim 19, wherein the trigger stop post is substantially cylindrical.

* * * * *